US010207128B2

(12) United States Patent
Hetrich

(10) Patent No.: US 10,207,128 B2
(45) Date of Patent: Feb. 19, 2019

(54) FALL PROTECTION DEVICE AND ADJUSTMENT MECHANISM THEREFOR

(71) Applicant: MSA Technology, LLC, Cranberry Township, PA (US)

(72) Inventor: Mitchell H. Hetrich, Greenville, PA (US)

(73) Assignee: MSA Technology, LLC, Cranberry Township, PA (US)

( * ) Notice: Subject to any disclaimer, the term of this patent is extended or adjusted under 35 U.S.C. 154(b) by 0 days.

(21) Appl. No.: 15/392,842

(22) Filed: Dec. 28, 2016

(65) Prior Publication Data

US 2018/0178044 A1 Jun. 28, 2018

(51) Int. Cl.

| | |
|---|---|
| ***A62B 1/08*** | (2006.01) |
| ***A62B 35/00*** | (2006.01) |
| ***A62B 1/10*** | (2006.01) |
| ***A62B 1/18*** | (2006.01) |

(52) U.S. Cl.

CPC ..... *A62B 1/08* (2013.01); *A62B 1/10* (2013.01); *A62B 1/18* (2013.01); *A62B 35/0043* (2013.01); *A62B 35/0093* (2013.01)

(58) Field of Classification Search

CPC ..... A62B 1/08; A62B 35/0043

See application file for complete search history.

(56) References Cited

U.S. PATENT DOCUMENTS 2,089,031 A * 8/1937 MacDonald ..... A01K 89/015 235/103
2,452,524 A * 10/1948 Metten ..... H01J 47/08 220/2.3 R
2,791,397 A * 5/1957 Coffman ..... A62B 35/0093 182/239
4,416,430 A * 11/1983 Totten ..... A62B 1/10 182/237
4,602,699 A * 7/1986 Matt ..... A62B 1/10 182/234
7,896,281 B2 3/2011 Bleshoy
2009/0260922 A1 10/2009 Marquardt et al.
2010/0116922 A1* 5/2010 Choate ..... A62B 35/04 242/384.7
2011/0158632 A1* 6/2011 Ono ..... G03B 19/12 396/358
2016/0338323 A1 11/2016 Nishida

FOREIGN PATENT DOCUMENTS

DE 202006010918 U1 11/2006

* cited by examiner

*Primary Examiner* — Alvin C Chin-Shue
(74) *Attorney, Agent, or Firm* — The Webb Law Firm

(57) ABSTRACT

A fall protection device, including: a housing; a hub rotatable with respect to the housing; a line wrapped around the hub and configured to pay out from and retract into the housing, an engagement mechanism configured to prevent rotation of the hub and further payout of the line; and an adjustment mechanism configured to adjust a length of the line paid out from the housing, the adjustment mechanism comprising: (i) at least one gear attached to the housing; (ii) a pivot having a track configured to interact with the at least one gear and pivot as the at least one gear rotates; and (iii) an arm configured to urge at least a portion of the engagement mechanism causing it to move into an engagement position, to thereby prevent further rotation of the hub and payout of the line from the fall protection device.

20 Claims, 8 Drawing Sheets

FALL PROTECTION DEVICE AND ADJUSTMENT MECHANISM THEREFOR

BACKGROUND OF THE INVENTION

Field of the Invention

The present invention relates generally to safety systems and arrangements and, in particular, to a fall protection device, such as a fall arrest or controlled descent device (including self-retracting lanyards, restraint systems, and the like), which may be used in connection with a harness to protect the wearer from a fall arrest event, as well as an adjustment mechanism for a fall protection device.

Description of the Related Art

A fall protection device may be used in a variety of situations and applications. For example, one type of fall protection device is in the form of a lanyard, such as a self-retracting lanyard (SRL), which is commonly used for fall protection in industrial environments, as well as in connection with recreational activities. Self-retracting lanyards have numerous industrial end uses, including, but not limited to, construction, manufacturing, hazardous materials/remediation, asbestos abatement, spray painting, sand blasting, welding, mining, numerous oil and gas industry applications, electric and utility, nuclear energy, paper and pulp, sanding, grinding, stage rigging, roofing, scaffolding, telecommunications, automotive repair and assembly, warehousing, and railroading.

SRLs frequently include a housing that includes a rotatable drum or hub around which a line, typically made of webbing, cable, rope, and/or synthetic material is wound. The hub rotates to release (or "payout") the line from its housing when a certain level of tension is purposefully applied. When that degree of tension is reduced or released, the hub can slowly rotate in a reverse direction causing the line to retract or rewind about itself in a desired manner. Certain housings further include a braking mechanism or assembly for resisting hub rotation when an inelastic line (e.g., a steel cable) unwinds too rapidly, i.e., faster than its predetermined maximum velocity for normal payout. A sudden line payout is an indication that the lanyard wearer/user has experienced a fall that needs to be stopped or arrested.

During an unintentional, accidental fall, an engagement mechanism and braking arrangement in the housing of the SRL engage, which prevents the SRL wearer from falling too far. In addition, SRLs typically connect at one end to an anchorage point, often on the support structure at or near where a user is performing certain assigned tasks. The line from the SRL housing is clamped (or otherwise attached) to a harness worn by the user. The maximum allowable stopping forces and distances are defined by known industry standards. The stopping force provided by a brake is inversely proportional to the stopping distance, i.e., the higher the force, the shorter the distance, and vice versa. As a result, the force cannot exceed the maximum allowed by standards, and yet it must also be large enough so that the extension distance does not exceed the maximum, also regulated by these standards.

Another type of fall protection device is referred to as a restraint device or system, with which the amount of line that should be paid out from the fall protection device varies according to the application and environment. For example, while the SRL may permit the maximum payout of 20 feet of line during normal operation, other applications may require that the line only be permitted to payout 10 feet based upon the location of the fall hazard (i.e., the fall hazard is 10 feet from the anchor point). In this situation, the SRL cannot be used effectively, since it will permit too much line to be paid out, which may result in a hazardous situation. Instead, the user will need to locate or otherwise obtain an SRL or restraint system or device with the proper payout line length.

Accordingly, there is a need in the art for a fall protection device that can be used in a variety of environments and applications by permitting the adjustment of the amount of line that is paid out from the fall protection device. Further, there is a need in the art for a fall protection device that allows a single device to be used in connection with both fall arrest and restraint applications.

SUMMARY OF THE INVENTION

Generally, provided are an improved fall protection device, such as a self-retracting lanyard, and an improved adjustment mechanism for use in connection with a fall protection device. Preferably, provided are an improved fall protection device and adjustment mechanism therefor that provide for the adjustment of the length of line that can be paid out from the fall protection device. Preferably, provided are an improved fall protection device and adjustment mechanism that are useful in connection with both fall arrest and restraint applications.

Accordingly, and in one preferred and non-limiting embodiment or aspect, provided is a fall protection device, comprising: a housing; a rotatable hub having a body and a central rotation axis around which the body rotates with respect to the housing; a line wrapped around the hub and configured to pay out from and retract into the housing, the line having a first end attached to the hub and a second end having a connector attached thereto and configured for attachment to a harness of a user; an engagement mechanism configured to prevent rotation of the hub and further payout of the line; and an adjustment mechanism configured to adjust a length of the line paid out from the housing, the adjustment mechanism comprising: (i) a central gear configured to rotate with the hub about the central rotation axis; (ii) at least one gear attached to the housing and configured to interact with the central gear; (iii) a pivot having a track configured to interact with the at least one gear and pivot as the at least one gear rotates; and (iv) an arm configured to urge at least a portion of the engagement mechanism causing it to move into an engagement position, to thereby prevent further rotation of the hub and payout of the line from the fall protection device.

In one preferred and non-limiting embodiment or aspect, the at least one gear comprises a first set of teeth configured to directly or indirectly interact with the central gear and a second set of teeth configured to directly or indirectly interact with the track of the pivot.

In one preferred and non-limiting embodiment or aspect, the at least one gear comprises a plurality of interacting gears configured to reduce the revolution rate of the at least one gear with respect to the revolution rate of the central gear. In another preferred and non-limiting embodiment or aspect, the plurality of interacting gears comprises: (i) a first gear comprising a first set of teeth configured to interact with the central gear and a second set of teeth; and (ii) a second gear comprising a first set of teeth configured to interact with the second set of teeth of the first gear and a second set of teeth configured to interact with the track of the pivot. In a further preferred and non-limiting embodiment or aspect, the radius of the second set of teeth of the first gear is less than the radius of the first set of teeth of the first gear, and the radius of the second set of teeth of the second gear is less than the first set of teeth of the second gear.

In one preferred and non-limiting embodiment or aspect, engagement and disengagement of the adjustment mechanism is effected through facilitating contact between the track of the pivot and the at least one gear.

In one preferred and non-limiting embodiment or aspect, a distance that the pivot moves into the engagement position is adjustable, thereby providing a specified length of line to be paid out prior to the arm urging at least a portion of the engagement mechanism into the engagement position. In another preferred and non-limiting embodiment or aspect, the engagement position is adjusted by engaging the at least one gear with the track of the pivot at a specified point. In a further preferred and non-limiting embodiment or aspect, the adjustment mechanism further comprises a knob attached to the pivot and configured to facilitate engagement and disengagement of the at least one gear and a track of the pivot at a specified point.

In one preferred and non-limiting embodiment or aspect, the arm of the pivot contacts at least one stud projecting from at least one component of the engagement mechanism.

In one preferred and non-limiting embodiment or aspect, the engagement mechanism comprises: (i) at least one sperrad attached to or integral with the housing; and (ii) at least one pawl attached to or integral with the hub and configured to contact at least a portion of the at least one sperrad, thereby preventing further rotation of the hub with respect to the housing.

In one preferred and non-limiting embodiment or aspect, provided is an adjustment mechanism for adjusting a length of a line that is paid out from a fall protection device, comprising: (i) a central gear configured to rotate with a hub about a central rotation axis; (ii) at least one gear attached to a housing of the fall protection device and configured to interact with the central gear; (iii) a pivot having a track configured to interact with the at least one gear and pivot as the at least one gear rotates; and (iv) an arm configured to urge at least a portion of an engagement mechanism causing it to move into an engagement position, to thereby prevent further rotation of the hub and payout of the line from the fall protection device.

In one preferred and non-limiting embodiment or aspect, the at least one gear comprises a first set of teeth configured to directly or indirectly interact with the central gear and a second set of teeth configured to directly or indirectly interact with the track of the pivot.

In one preferred and non-limiting embodiment or aspect, the at least one gear comprises a plurality of interacting gears configured to reduce the revolution rate of the at least one gear with respect to the revolution rate of the central gear. In another preferred and non-limiting embodiment or aspect, the plurality of interacting gears comprises: (i) a first gear comprising a first set of teeth configured to interact with the central gear and a second set of teeth; and (ii) a second gear comprising a first set of teeth configured to interact with the second set of teeth of the first gear and a second set of teeth configured to interact with the track of the pivot. In a further preferred and non-limiting embodiment or aspect, the radius of the second set of teeth of the first gear is less than the radius of the first set of teeth of the first gear, and the radius of the second set of teeth of the second gear is less than the first set of teeth of the second gear.

In one preferred and non-limiting embodiment or aspect, the engagement mechanism comprises: (i) at least one sperrad attached to or integral with the housing; and (ii) at least one pawl attached to or integral with the hub and configured to contact at least a portion of the at least one sperrad, thereby preventing further rotation of the hub with respect to the housing.

In one preferred and non-limiting embodiment or aspect, a distance that the pivot moves into the engagement position is adjustable. In another preferred and non-limiting embodiment or aspect, the engagement position is adjusted by engaging the at least one gear with the track of the pivot at a specified point.

In one preferred and non-limiting embodiment or aspect, the adjustment mechanism further comprises a knob attached to the pivot and configured to facilitate engagement and disengagement of the at least one gear and a track of the pivot at a specified point.

In one preferred and non-limiting embodiment or aspect, the arm of the pivot contacts at least one stud projecting from an at least one pawl.

In one preferred and non-limiting embodiment or aspect, provided is a fall protection device, comprising: a housing; a rotatable hub having a body and a central rotation axis around which the body rotates with respect to the housing; a line wrapped around the hub and configured to pay out from and retract into the housing, the line having a first end attached to the hub and a second end having a connector attached thereto and configured for attachment to a harness of a user; an engagement mechanism configured to prevent further rotation of the hub and pay out of the line, the engagement mechanism comprising: (i) at least one sperrad attached to or integral with the housing; and (ii) at least one pawl attached to or integral with the hub and configured to contact at least a portion of the at least one sperrad, thereby preventing further rotation of the hub with respect to the housing; a braking mechanism configured to slow the rotation of the hub upon activation of the engagement mechanism; and an adjustment mechanism configured to adjust a length of the line paid out from the housing, the adjustment mechanism comprising: (i) a central gear configured to rotate with the hub about the central rotation axis; (ii) at least one gear attached to the housing and configured to interact with the central gear; (iii) a pivot having a track configured to interact with the at least one gear and pivot as the at least one gear rotates; and (iv) an arm configured to urge the at least one pawl causing it to move into engagement with the at least one sperrad when the pivot pivots to an engagement position.

In one preferred and non-limiting embodiment or aspect, a distance that the pivot moves into the engagement position is adjustable.

Further preferred and non-limiting embodiments or aspects of the present invention are described in the following numbered clauses:

Clause 1: A fall protection device, comprising: a housing; a rotatable hub having a body and a central rotation axis around which the body rotates with respect to the housing; a line wrapped around the hub and configured to pay out from and retract into the housing, the line having a first end attached to the hub and a second end having a connector attached thereto and configured for attachment to a harness of a user; an engagement mechanism configured to prevent rotation of the hub and further payout of the line; and an adjustment mechanism configured to adjust a length of the line paid out from the housing, the adjustment mechanism comprising: (i) a central gear configured to rotate with the hub about the central rotation axis; (ii) at least one gear attached to the housing and configured to interact with the central gear; (iii) a pivot having a track configured to interact with the at least one gear and pivot as the at least one gear rotates; and (iv) an arm configured to urge at least a portion of the engagement mechanism causing it to move into an engagement position, to thereby prevent further rotation of the hub and payout of the line from the fall protection device.

Clause 2: The fall protection device of clause 1, wherein the at least one gear comprises a first set of teeth configured to directly or indirectly interact with the central gear and a second set of teeth configured to directly or indirectly interact with the track of the pivot.

Clause 3: The fall protection device of clause 1 or 2, wherein the at least one gear comprises a plurality of interacting gears configured to reduce the revolution rate of the at least one gear with respect to the revolution rate of the central gear.

Clause 4: The fall protection device of any of clauses 1-3, wherein engagement and disengagement of the adjustment mechanism is effected through facilitating contact between the track of the pivot and the at least one gear.

Clause 5: The fall protection device of any of clauses 1-4, wherein a distance that the pivot moves into the engagement position is adjustable, thereby providing a specified length of line to be paid out prior to the arm urging at least a portion of the engagement mechanism into the engagement position.

Clause 6: The fall protection device of any of clauses 1-5, wherein the engagement position is adjusted by engaging the at least one gear with the track of the pivot at a specified point.

Clause 7: The fall protection device of any of clauses 1-6, wherein the arm of the pivot contacts at least one stud projecting from at least one component of the engagement mechanism.

Clause 8: The fall protection device of any of clauses 1-7, wherein the engagement mechanism comprises: (i) at least one sperrad attached to or integral with the housing; and (ii) at least one pawl attached to or integral with the hub and configured to contact at least a portion of the at least one sperrad, thereby preventing further rotation of the hub with respect to the housing.

Clause 9: An adjustment mechanism for adjusting a length of a line that is paid out from a fall protection device, comprising: (i) a central gear configured to rotate with a hub about a central rotation axis; (ii) at least one gear attached to a housing of the fall protection device and configured to interact with the central gear; (iii) a pivot having a track configured to interact with the at least one gear and pivot as the at least one gear rotates; and (iv) an arm configured to urge at least a portion of an engagement mechanism causing it to move into an engagement position, to thereby prevent further rotation of the hub and payout of the line from the fall protection device.

Clause 10: The adjustment mechanism of clause 9, wherein the at least one gear comprises a first set of teeth configured to directly or indirectly interact with the central gear and a second set of teeth configured to directly or indirectly interact with the track of the pivot.

Clause 11: The adjustment mechanism of clause 9 or 10, wherein the at least one gear comprises a plurality of interacting gears configured to reduce the revolution rate of the at least one gear with respect to the revolution rate of the central gear.

Clause 12: The adjustment mechanism of any of clauses 9-11, wherein the plurality of interacting gears comprises: (i) a first gear comprising a first set of teeth configured to interact with the central gear and a second set of teeth; and (ii) a second gear comprising a first set of teeth configured to interact with the second set of teeth of the first gear and a second set of teeth configured to interact with the track of the pivot.

Clause 13: The adjustment mechanism of any of clauses 9-12, wherein the radius of the second set of teeth of the first gear is less than the radius of the first set of teeth of the first gear, and the radius of the second set of teeth of the second gear is less than the first set of teeth of the second gear.

Clause 14: The adjustment mechanism of any of clauses 9-13, wherein the engagement mechanism comprises: (i) at least one sperrad attached to or integral with the housing; and (ii) at least one pawl attached to or integral with the hub and configured to contact at least a portion of the at least one sperrad, thereby preventing further rotation of the hub with respect to the housing.

Clause 15: The adjustment mechanism of any of clauses 9-14, wherein a distance that the pivot moves into the engagement position is adjustable.

Clause 16: The adjustment mechanism of any of clauses 9-15, wherein the engagement position is adjusted by engaging the at least one gear with the track of the pivot at a specified point.

Clause 17: The adjustment mechanism of any of clauses 9-16, further comprising a knob attached to the pivot and configured to facilitate engagement and disengagement of the at least one gear and a track of the pivot at a specified point.

Clause 18: The adjustment mechanism of any of clauses 9-17, wherein the arm of the pivot contacts at least one stud projecting from an at least one pawl.

Clause 19: A fall protection device, comprising: a housing; a rotatable hub having a body and a central rotation axis around which the body rotates with respect to the housing; a line wrapped around the hub and configured to pay out from and retract into the housing, the line having a first end attached to the hub and a second end having a connector attached thereto and configured for attachment to a harness of a user; an engagement mechanism configured to prevent further rotation of the hub and pay out of the line, the engagement mechanism comprising: (i) at least one sperrad attached to or integral with the housing; and (ii) at least one pawl attached to or integral with the hub and configured to contact at least a portion of the at least one sperrad, thereby preventing further rotation of the hub with respect to the housing; a braking mechanism configured to slow the rotation of the hub upon activation of the engagement mechanism; and an adjustment mechanism configured to adjust a length of the line paid out from the housing, the adjustment mechanism comprising: (i) a central gear configured to rotate with the hub about the central rotation axis; (ii) at least one gear attached to the housing and configured to interact with the central gear; (iii) a pivot having a track configured to interact with the at least one gear and pivot as the at least one gear rotates; and (iv) an arm configured to urge the at least one pawl causing it to move into engagement with the at least one sperrad when the pivot pivots to an engagement position.

Clause 20: The fall protection device of clause 19, wherein a distance that the pivot moves into the engagement position is adjustable.

Clause 21: A fall protection device, comprising: a housing; a rotatable hub having a body and a central rotation axis around which the body rotates with respect to the housing; a line wrapped around the hub and configured to pay out from and retract into the housing, the line having a first end attached to the hub and a second end having a connector attached thereto and configured for attachment to a harness of a user; an engagement mechanism configured to prevent rotation of the hub and further payout of the line; and an adjustment mechanism configured to adjust a length of the line paid out from the housing, the adjustment mechanism comprising: (i) at least one gear attached to the housing; (ii) a pivot having a track configured to interact with the at least one gear and pivot as the at least one gear rotates; and (iii) an arm configured to urge at least a portion of the engagement mechanism causing it to move into an engagement position, to thereby prevent further rotation of the hub and payout of the line from the fall protection device.

Clause 22: An adjustment mechanism for adjusting a length of a line that is paid out from a fall protection device, comprising: (i) at least one gear attached to a housing of the fall protection device; (ii) a pivot having a track configured to interact with the at least one gear and pivot as the at least one gear rotates; and (iii) an arm configured to urge at least a portion of an engagement mechanism causing it to move into an engagement position, to thereby prevent further rotation of the hub and payout of the line from the fall protection device.

Clause 23: The adjustment mechanism of clause 21 or 22, wherein the at least one gear comprises at least one of the following: a central gear, a single gear configured to interact with a central gear, a plurality of gears configured to interact with each other and/or a central gear, or any combination thereof.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DETAILED DESCRIPTION OF THE INVENTION

Figure 1:
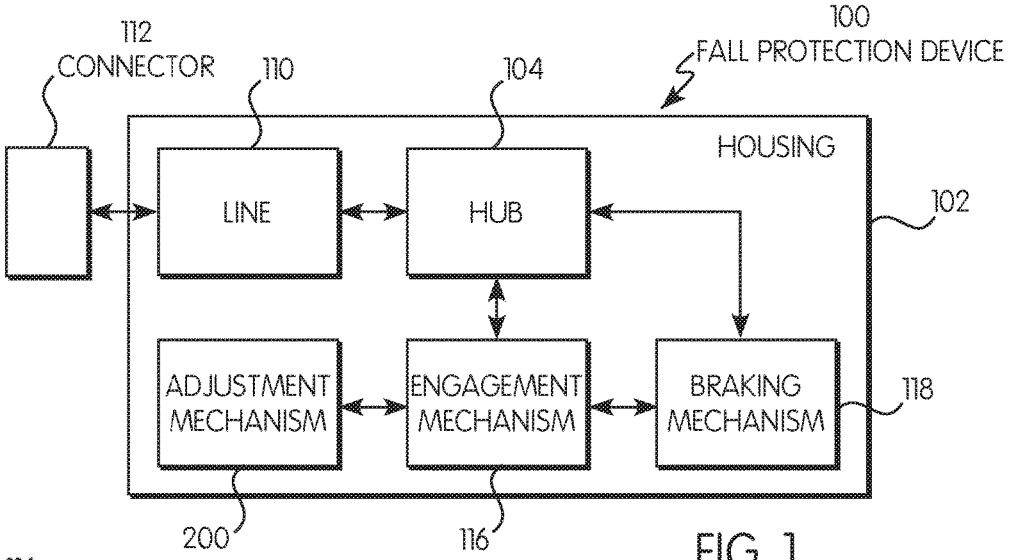
FIG. 1 is a schematic view of one embodiment of a fall protection device and adjustment mechanism according to the principles of the present invention.

For purposes of the description hereinafter, the terms "end", "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations and step or stage sequences, except where expressly specified to the contrary. It is also to be understood that the specific devices and processes illustrated in the attached drawings, and described in the following specification, are simply exemplary embodiments or aspects of the invention. Hence, specific dimensions and other physical characteristics related to the embodiments or aspects disclosed herein are not to be considered as limiting.

The present invention is directed to a fall protection device 100 and an adjustment mechanism 200 for such a fall protection device 100, as illustrated in certain preferred and non-limiting embodiments or aspects and in schematic form in FIGS. 1-9(*b*). The fall protection device 100 may be in the form of a lanyard, a self-retracting lanyard, a line retraction device, a controlled descent device, a restraint device, a fall arrest device, and/or the like.

Figure 2:
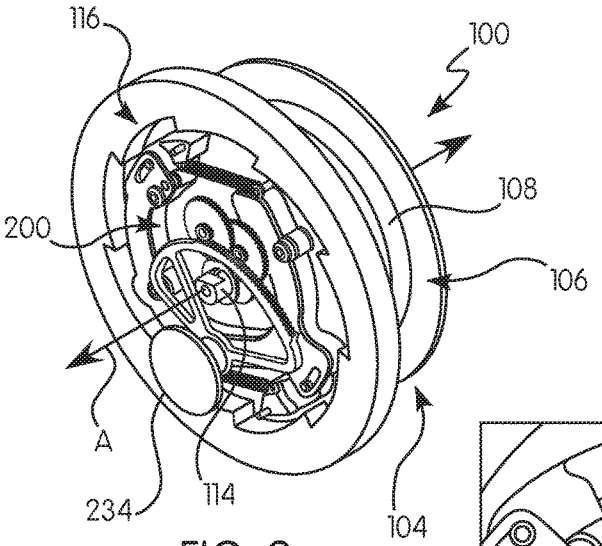
FIG. 2 is a perspective view of a portion of a fall protection device and an adjustment mechanism according to the principles of the present invention.

In one preferred and non-limiting embodiment or aspect, and with reference to FIGS. 1 and 2, the fall protection device includes a housing 102, which includes a generally hollow interior and is sized and shaped to surround and/or contain one or more internal components or parts of the fall protection device 100. Further, this housing 102 is considered stationary with respect to the moving components of the fall protection device 100. The fall protection device 100 further includes a hub 104 with a body 106 configured to rotate about a central rotation axis (A). In one preferred and non-limiting embodiment or aspect, the body 106 of the hub 104 includes a winding section 108 and a line 110, such as a cable, a web, an elongated member, or the like, that is wrapped around or wound about the winding section 108 of the body 106. The line 110 includes a first end directly or indirectly attached to the body 106 of the hub 104 and a second end, opposite the first end, having a connector 112 for removable attachment to a user, e.g., a harness (not shown) worn by the user. In this manner, the line 110 is configured to be paid out from and retracted into the housing 102.

Figure 4:
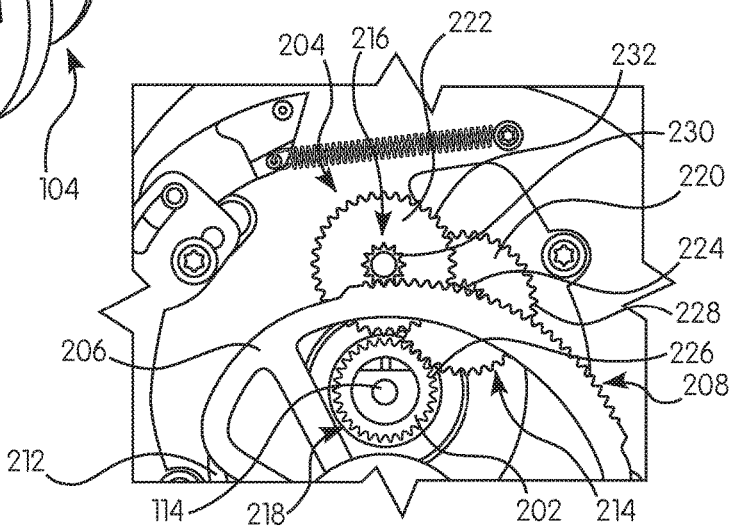
FIG. 4 is a partial side view of the fall protection device and adjustment mechanism of FIG. 2.
Figure 3:
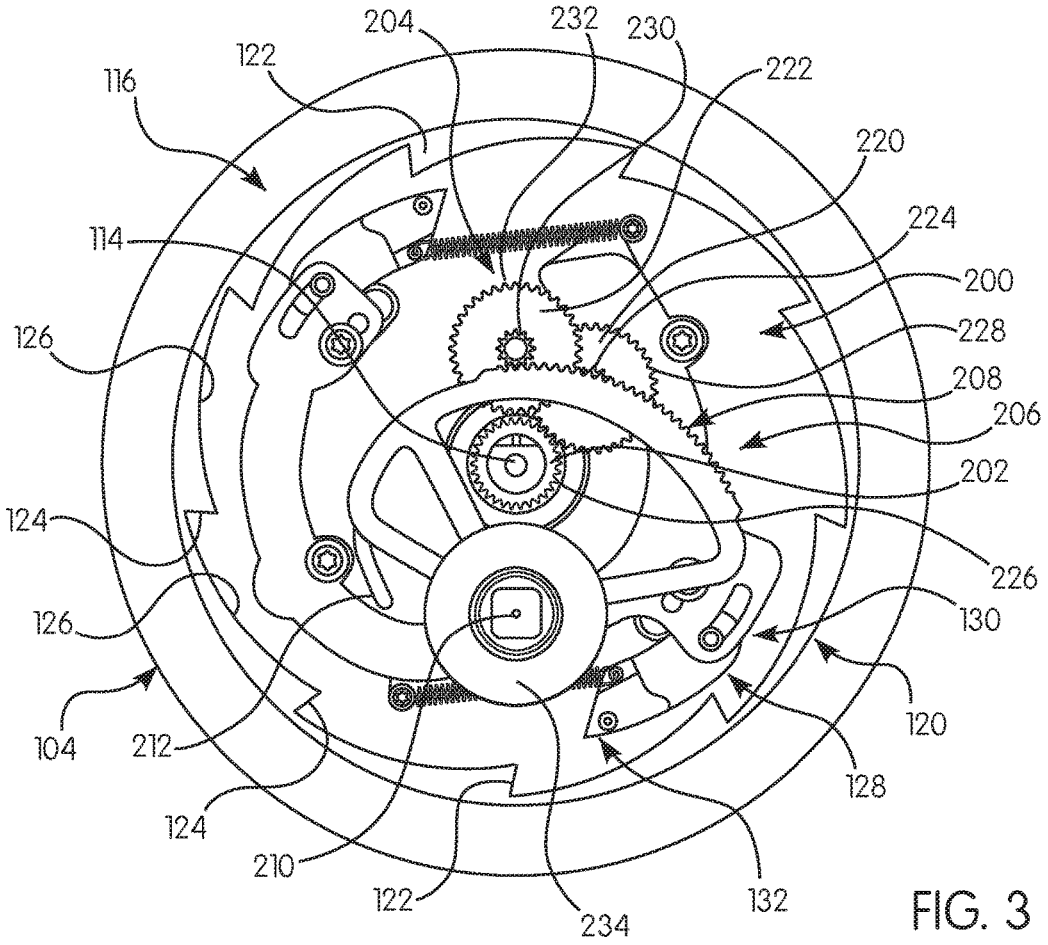
FIG. 3 is a side view of the fall protection device and adjustment mechanism of FIG. 2.
Figure 5:
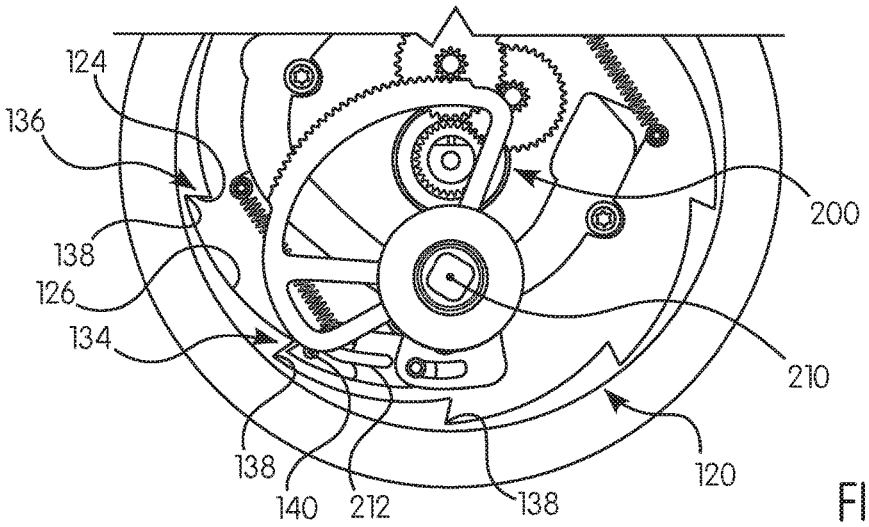
FIG. 5 is a partial side view of the fall protection device and adjustment mechanism of FIG. 2, wherein the adjustment mechanism has been activated.
Figure 7A:
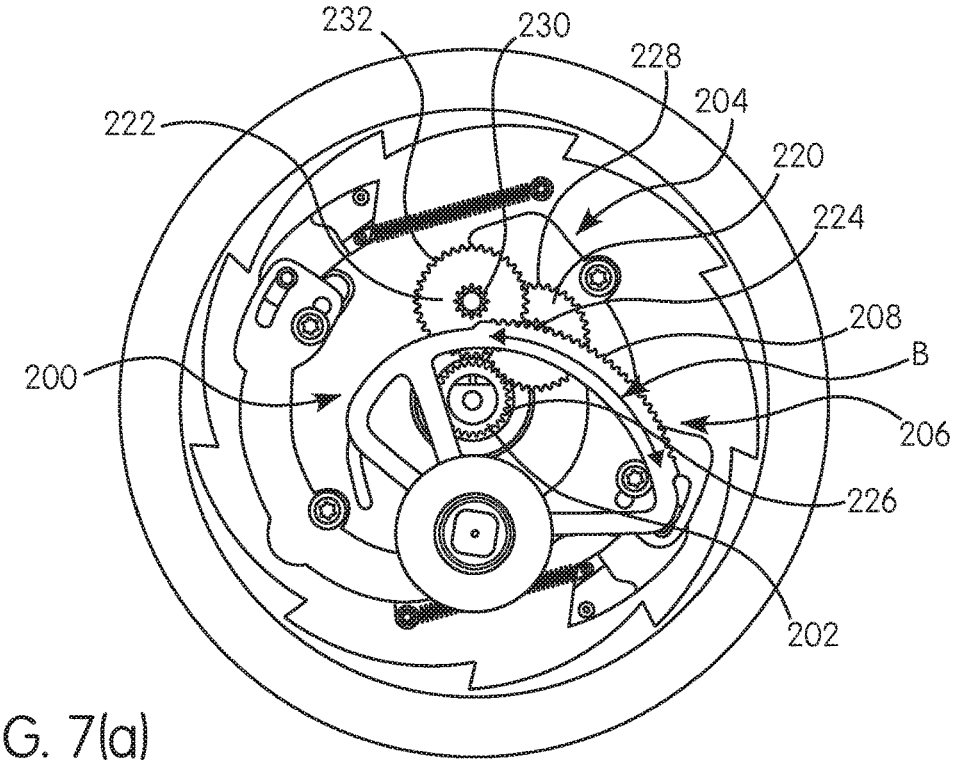
FIGS. 7(*a*)-7(*d*) are side views of the fall protection device and adjustment mechanism of FIG. 2, wherein the adjustment mechanism is positioned in various positions for activation or non-activation.
Figure 7B:
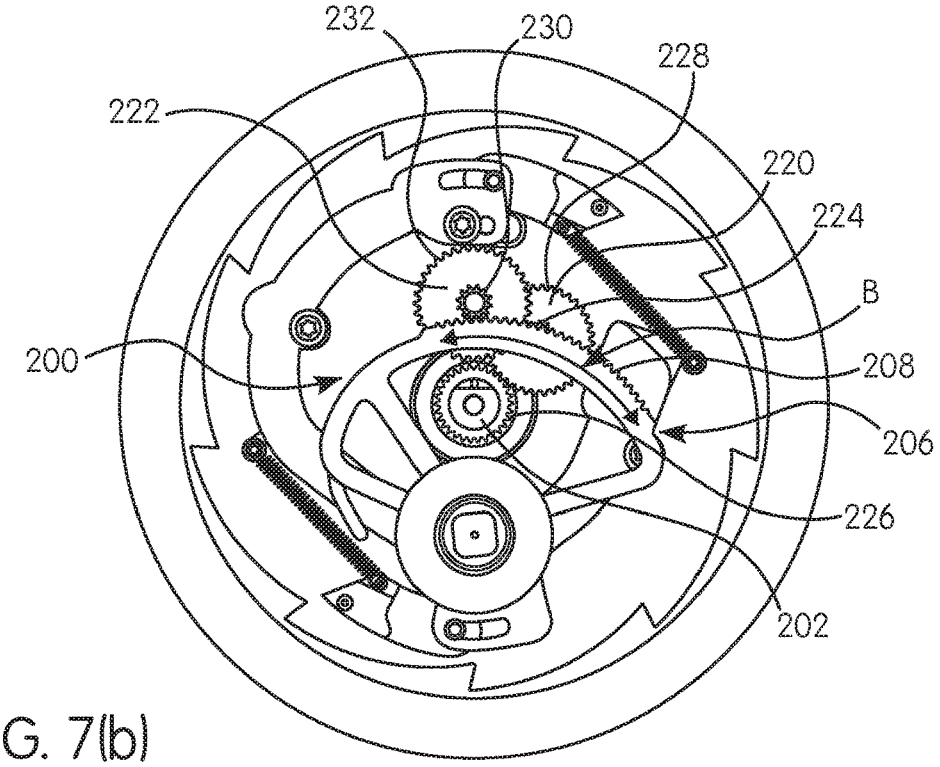
Figure 7C:
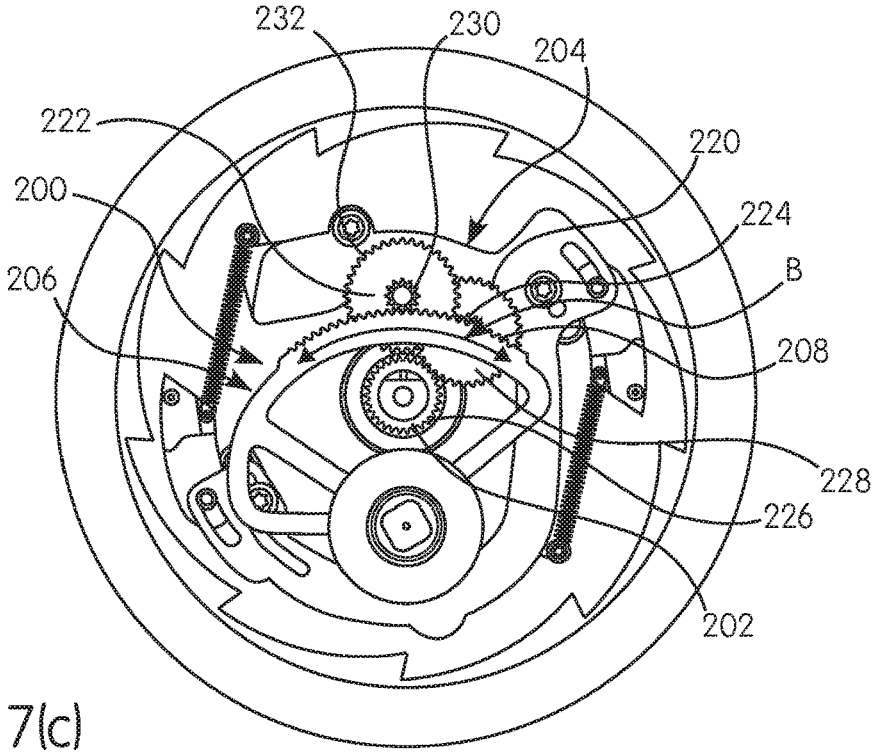
Figure 7D:
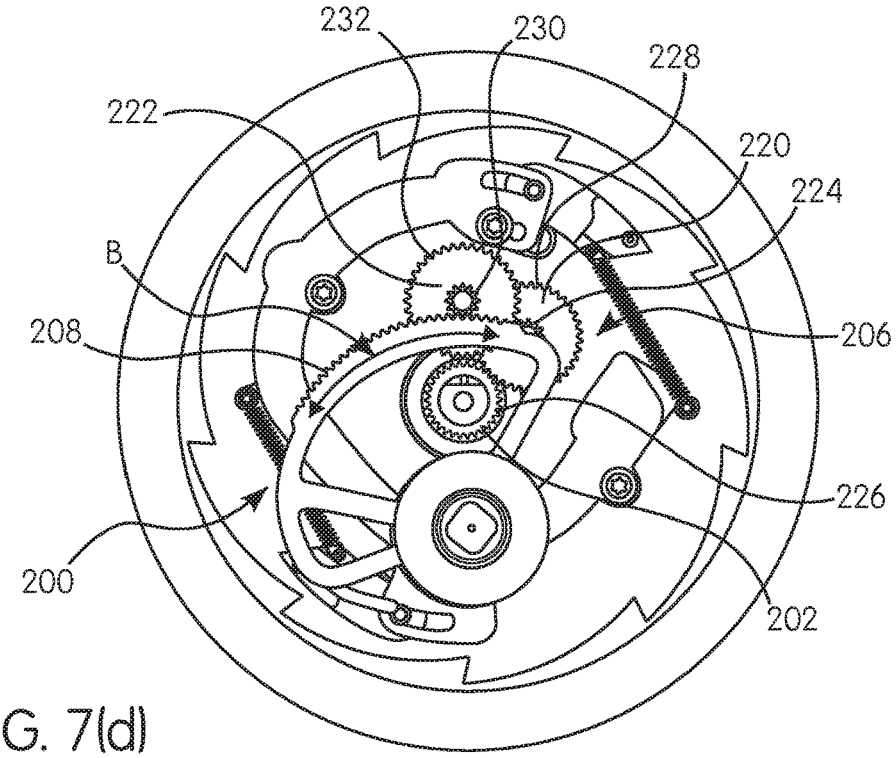

When the winding section 108 of the body 106 of the hub 104 is retracting or releasing the line 110, and with reference to FIGS. 3-5, the hub 104 rotates about a shaft 114 (which, in one preferred and non-limiting embodiment or aspect, defines the central rotation axis (A)). It is recognized that, in some embodiments, the shaft 114 rotates with the hub 104, and in other embodiments, the hub 104 rotates around the shaft 114, i.e., the shaft 114 is stationary with respect to the rotating hub 104. It will be apparent to those of ordinary skill in the art that any arrangement in reverse or symmetrical adjustment of the inner structure of the fall protection device 100 or the adjustment mechanism 200 of the present invention may be made to the disclosed embodiments without departing from the spirit and scope of the invention, and falls into the protection scope of the invention.

With continued reference to FIGS. 1-5, and in another preferred and non-limiting embodiment or aspect, the fall protection device 100 further includes an engagement mechanism 116 configured to prevent rotation of the hub 104 and further payout of the line 110 from the winding section 108 of the body 106 of the hub 104. In one preferred and non-limiting embodiment or aspect, the fall protection device 100 includes a braking mechanism 118 configured to slow the rotation of the hub 104 upon activation of the engagement mechanism 116. In this manner, when the engagement mechanism 116 engages or activates, the user is not subject to a sudden or immediate (and potentially harmful) stoppage of the payout of the line 110 during a fall event.

As discussed above, the fall protection device 100 includes an adjustment mechanism 200, which is configured to adjust the length of the line 110 paid out from the housing 102. In one preferred and non-limiting embodiment or aspect, the adjustment mechanism 200 includes a central gear 202 configured to rotate with the hub 104 about the central rotation axis (A). It should be recognized that in embodiments where it is the central shaft 114 that rotates with respect to the hub 104, the central gear 202 will be directly or indirectly attached to and configured to rotate together with the central shaft 114. The adjustment mechanism 200 of this embodiment further includes at least one gear 204 directly or indirectly attached to the housing 102 (or some other stationary component of the fall protection device 100) and configured to interact with the central gear 202.

A pivot 206 is provided and includes a track 208 configured to directly or indirectly interact with the at least one gear 204 and pivot as the at least one gear 204 rotates. In one preferred and non-limiting embodiment or aspect, and to facilitate the pivoting motion of the pivot 206, the track 208 may be arcuate to allow movement about a pivot point 210. Specifically, as the central gear 202 rotates (e.g., rotates together with the rotating shaft 114, or alternatively, rotates together with the rotating hub 104), and based upon the interaction between: (1) the central gear 202 and the at least one gear 204; and (2) the at least one gear 204 and the track 208 of the pivot 206, the pivot 206 moves (or pivots) about the pivot point 210 (or area). As the pivot 206 moves, an arm 212, or some other contact projection or surface, is sized, shaped, or configured to move towards and contact or urge at least a portion, or a component, of the engagement mechanism 116 into an engagement position. Once engaged, and as discussed above, the engagement mechanism 116 will prevent further rotation of the hub 104 and further payout of the line 110. In this manner, the length of line 110 that is permitted to released or paid out from the hub 104 is configurable and limited by operation of the adjustment mechanism 200. Accordingly, the adjustment mechanism 200 is configurable to adjust the amount of line 110 that can be used during normal operation of the fall protection device 100.

In one preferred and non-limiting embodiment or aspect, the at least one gear 204 includes a first set of teeth 214 configured to directly or indirectly interact with the central gear 202 and a second set of teeth 216 configured to directly or indirectly interact with the track 208 of the pivot 206. In particular, the first set of teeth 214 of the at least one gear 204 is configured to interact or mate with a set of teeth 218 disposed on the central gear 202, such that as the central gear 202 rotates, the interaction between the first set of teeth 214 of the at least one gear 204 and the set of teeth 218 of the central gear 202 causes the at least one gear 204 to rotate. As discussed above, and based upon the rotation of the at least one gear 204, as well as the interaction between the second set of teeth 216 of the at least one gear 204 and the track 208 of the pivot 206, the movement of the pivot 206 causes the arm 212 to move toward and contact (or engage) a component or portion of the engagement mechanism 116 to cause the engagement mechanism 116 to engage and prevent further rotation of the hub 104 and payout of the line 110 from the winding section 108 of the body 106 of the hub 104. Accordingly, the engagement mechanism 116 is activated and moves from a non-engagement position (as illustrated in FIG. 3) to an engaged or activated position (as illustrated in FIG. 5).

In one preferred and non-limiting embodiment or aspect, and with reference to FIGS. 2-5, the fall protection device 100 includes a plurality of gears 204, such as first gear 220 and second gear 222. By using multiple, interacting gears 204, e.g., the first gear 220 and the second gear 222, the revolution rate of the central gear 202 (which is rotating as the line 110 is being paid out or retracted) can be reduced with respect to the revolution rate of the gears 204 and the track 208 of the pivot 206. In this manner, the length of the track 208 may be shortened and the movement of the pivot 206 slowed with respect to the spinning central gear 202.

As discussed above, the adjustment mechanism 200 may include the first gear 220 and the second gear 222. In one preferred and non-limiting embodiment or aspect, the first gear 220 includes a first set of teeth 228 configured to interact with a set of teeth 226 of the central gear 202, and the first gear 220 includes a second set of teeth 224. The second gear 222 includes a first set of teeth 232 configured to interact with the second set of teeth 224 of the first gear 220 and a second set of teeth 230 configured to interact with the track 208 of the pivot 206. Accordingly, through the interaction between the teeth 228, 226 of the first gear 220 and central gear 202, the teeth 224, 232 of the first gear 220 and the second gear 222, and the teeth 230 and track 208, the pivot 206 is operable to move (or pivot), and move the arm 212 to contact and cause the engagement or operation of the engagement mechanism 116 of the fall protection device 100.

In another preferred and non-limiting embodiment or aspect, and as best illustrated in FIGS. 3-5, the radius of the second set of teeth 224 of the first gear 220 is less than the radius of the first set of teeth 228 of the first gear 220, and the radius of the second set of teeth 230 of the second gear 222 is less than the first set of teeth 232 of the second gear 222. Using these size differences, the rotating movement of the central gear 202 (which is either attached to the rotating shaft 114, or, in an alternate embodiment, the rotating hub 104) is reduced with respect to the movement of the second set of teeth 230 of the second gear 222 along the track 208 of the pivot 206. Again, this provides a configurable and reduced sizing of the pivot 206, which facilitates a more compact attachment or integration with the internal components within the housing 102 of the fall protection device 100.

Figure 6:
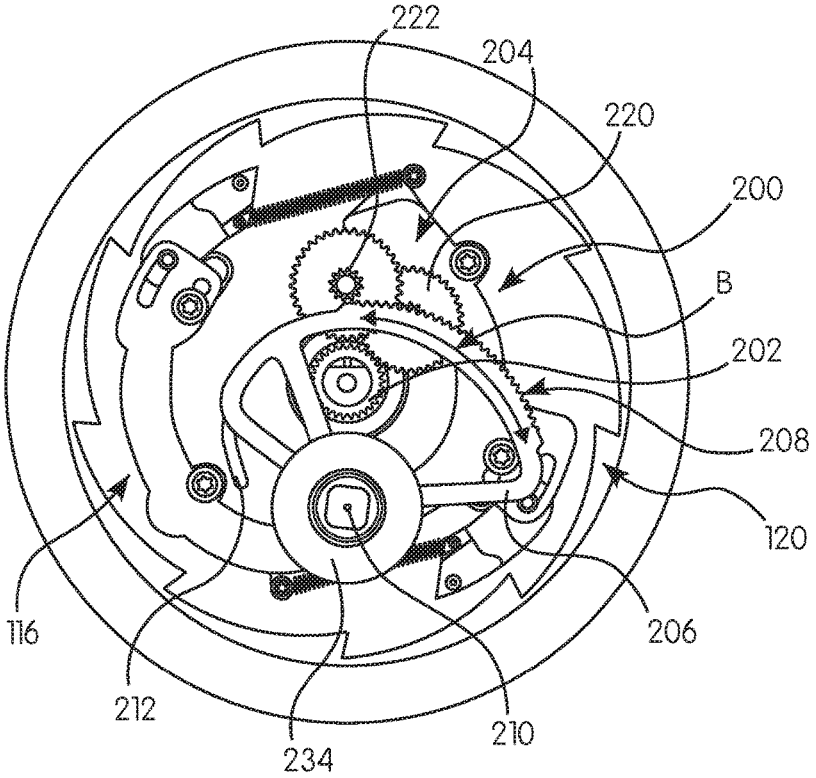
FIG. 6 is a side view of the fall protection device and adjustment mechanism of FIG. 2.
Figure 8:
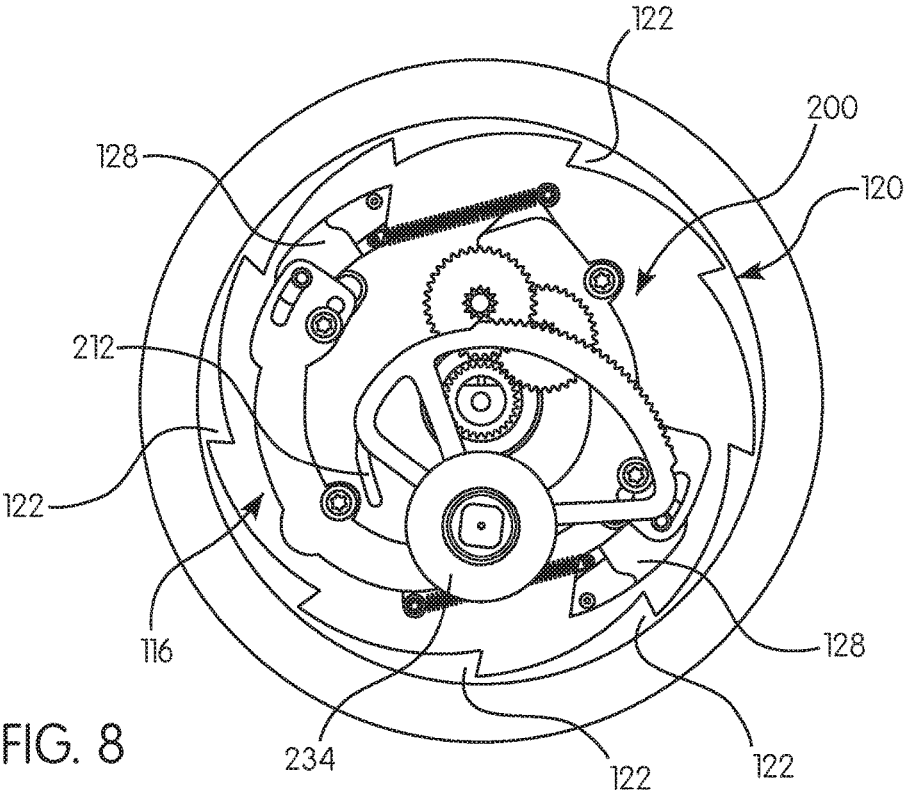
FIG. 8 is a side view of the fall protection device and adjustment mechanism of FIG. 2.

In one preferred and non-limiting embodiment or aspect, and with reference to FIGS. 6-8, the distance that the pivot 206 moves into the engagement position and causes the engagement mechanism 116 to activate is adjustable. In this manner, a specified length of line 110 to be paid out prior to the arm 212 contacting or urging at least a portion of the engagement mechanism 116 into the engagement position can be adjusted based upon the amount of distance the at least one gear 204 (e.g., the second gear 222) moves along the track 208, such as along the arcuate track 208 shown and described. As illustrated in FIG. 6, the at least one gear 204 (i.e., the second set of teeth 216) is mated or connected with the track 208 at a point along the track 208, as represented by Arrow B. It is this engagement position that determines the amount of time that elapses before which the adjustment mechanism 200 causes operation or activation of the fall protection device 100, which equates to the amount of line 110 that is permitted to be extracted from the winding section 108.

FIGS. 7(*a*)-7(*d*) illustrate various exemplary engagement positions; however, it should be recognized that the engagement position can be located at any point along the length of the track 208, i.e., along Arrow B. Accordingly, substantially continuous adjustment along the track 208 permits the user to choose any length of line 110 to be paid out (by adjusting the distance for engagement) anywhere between full payout (i.e., no engagement between the at least one gear 204 and the track 208 of the pivot (e.g., see FIGS. 6 and 8)) and a minimum amount of line payout. FIG. 7(*a*) illustrates no engagement between the at least one gear 204 and the track 208 (i.e., full payout, such as 20 feet of a 20-foot line), FIG. 7(*b*) illustrates a first intermediate engagement position (i.e., three-quarter payout, such as 15 feet of a 20-foot line), FIG. 7(*c*) illustrates a second intermediate engagement position (i.e., half payout, such as 10 feet of a 20-foot line), and FIG. 7(*d*) illustrates a third intermediate engagement position (i.e., one-quarter payout, such as 5 feet for a 20-foot line). Therefore, and dependent upon the full length or payout of the line 110, the user may select the maximum amount of line 110 that can be released prior to activation of the engagement mechanism 116 by the adjustment mechanism 200.

Figure 9A:
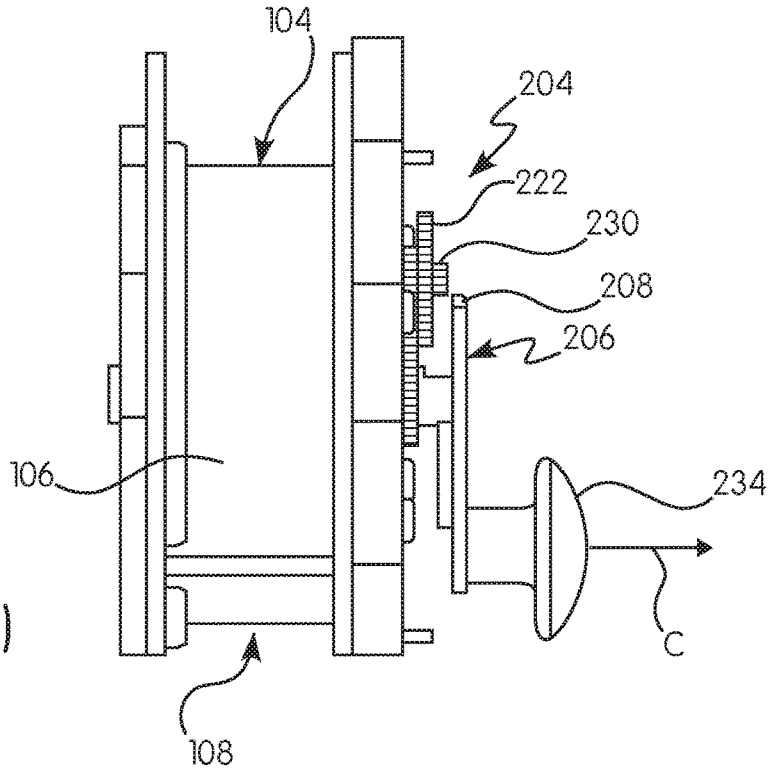
FIGS. 9(*a*)-9(*b*) are edge views of the fall protection device and adjustment mechanism of FIG. 2, wherein a knob is illustrated in disengaged and engaged positions.
Figure 9B:
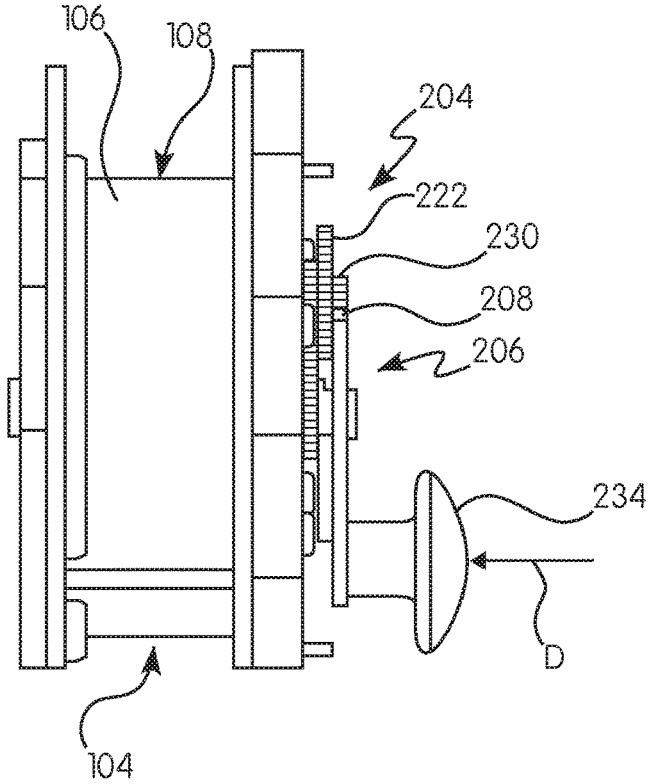

In order to facilitate the movement or location of the engagement point between the at least one gear 204 and the track 208 of the pivot 206, and in one preferred and non-limiting embodiment or aspect, the adjustment mechanism 200 includes a knob 234 directly or indirectly attached to the pivot 206 (or, in an alternate embodiment, some other component of the adjustment mechanism 200). The knob 234 is configured to facilitate engagement and disengagement of the at least one gear 204 and the track 208 of the pivot 206 at the specified point, or to a point of disengagement, i.e., full payout of the line 110. As shown in FIG. 9(*a*), the knob 234 (which, in one preferred and non-limiting embodiment or aspect, is attached to the pivot 206) is pulled away from the hub 104 in the direction of Arrow C, thereby disengaging the at least one gear 204 (e.g., second gear 222) and the track 208 of the pivot. The knob 234 (and, therefore, the pivot 206) can then be moved back and forth about the pivot point 210 along Arrow B (shown in FIG. 6) to the desired position. Once the at least one gear 204 is in the desired position along the track 208, the knob 234 is moved or urged in the direction of Arrow D to reengage the at least one gear 204 and the track 208, as illustrated in FIG. 9(*b*). Accordingly, the knob 234 can be used to select the engagement position that corresponds with the timing (and, thus, the length of line 110) for causing the engagement mechanism 116 to activate and prevent further release of the line 110.

In one preferred and non-limiting embodiment or aspect, and with reference to FIGS. 2-5, the engagement mechanism 116 includes at least one sperrad 120 attached to or integral with the housing 102, and this at least one sperrad 120 includes at least one contact projection 122 having a stop surface 124 and a sloped guide surface 126. In this embodiment, the engagement mechanism 116 further includes at least one pawl 128 attached to or integral with the hub 104, such that the at least one pawl 128 spins along with the hub 104. The at least one pawl 128 includes a pivot end 130 and a contact end 132, such that when the at least one pawl 128 is activated (i.e., acted upon by at least one component (e.g., the arm 212) of the adjustment mechanism 100), the at least one pawl 128 pivots about the pivot end 130 thereby moving the contact end 132 towards the at least one sperrad 120. During rotation, and when the contact end 132 of the at least one pawl 128 moves to a specified engagement position, the contact end 132 contacts at least a portion (e.g., the stop surface 124 of the at least one contact projection 122) of the at least one sperrad 120, thereby preventing further rotation of the hub 104 with respect to the housing 102. This activation of the engagement mechanism 116 causes the hub 104 to cease rotation and further payout of the line 110.

In one preferred and non-limiting embodiment or aspect, the at least one sperrad 120 includes multiple contact projections 122 that are directly or indirectly positioned on or integral with the housing 102 (or some other immovable component of the fall protection device 100). In such an embodiment, and during activation, the at least one pawl 128 pivots and the contact end 132 moves along or adjacent the guide surface 126 of a first contact portion 134 and impacts or contacts the stop surface 124 of a second, adjacent contact portion 136, specifically in a corner 138 created by the guide surface 126 of the first contact portion 134 and the stop surface 124 of the second contact portion 136. As discussed, this engagement between the at least one pawl 128 and the at least one sperrad 120 prevents further hub 104 rotation. FIGS. 2-4 illustrate an embodiment where the at least one pawl 128 is rotating in a disengagement position, and FIG. 5 illustrates an embodiment where the at least one pawl 128 is moving into an engagement position.

Figure 10:
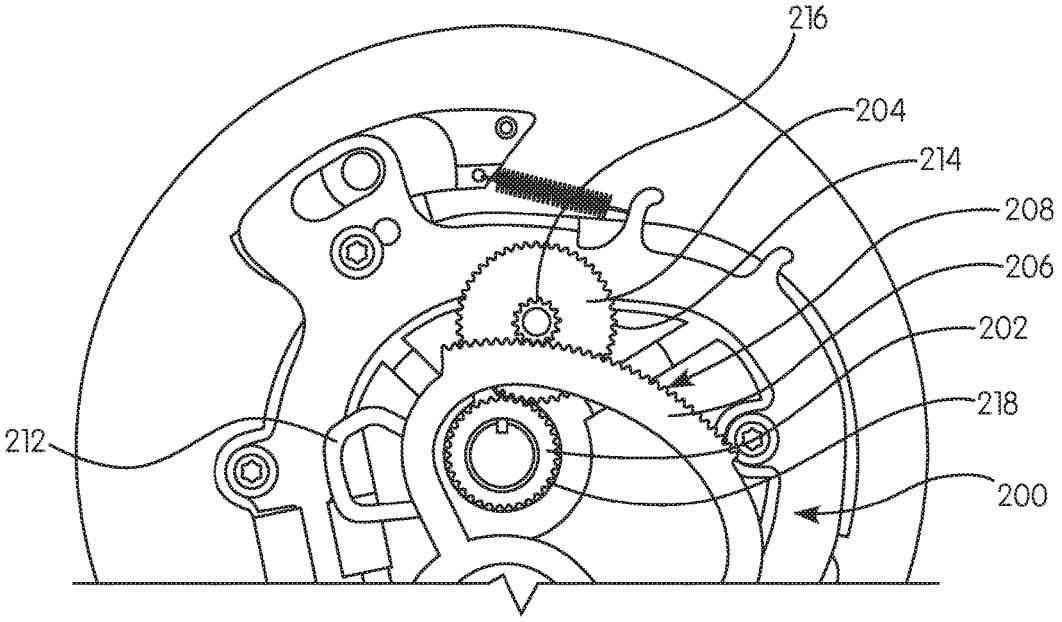
FIG. 10 is a partial side view of another embodiment of a fall protection device and adjustment mechanism according to the principles of the present invention.

In one preferred and non-limiting embodiment or aspect, and as illustrated in FIG. 10, the adjustment mechanism 200 includes a single gear 204, where the first set of teeth 214 interact or mate with the set of teeth 218 of the central gear 202 and the second set of teeth 216 interact or mate with the track 208 of the pivot 206. In this embodiment, the revolution rate reduction is provided is provided by the difference in radius (or diameter) between the first set of teeth 214 of the gear 204 and the second set of teeth 216 of the gear 204. In addition, the embodiment of FIG. 4 illustrates another variation of the size and shape of the arm 212.

Figure 11:
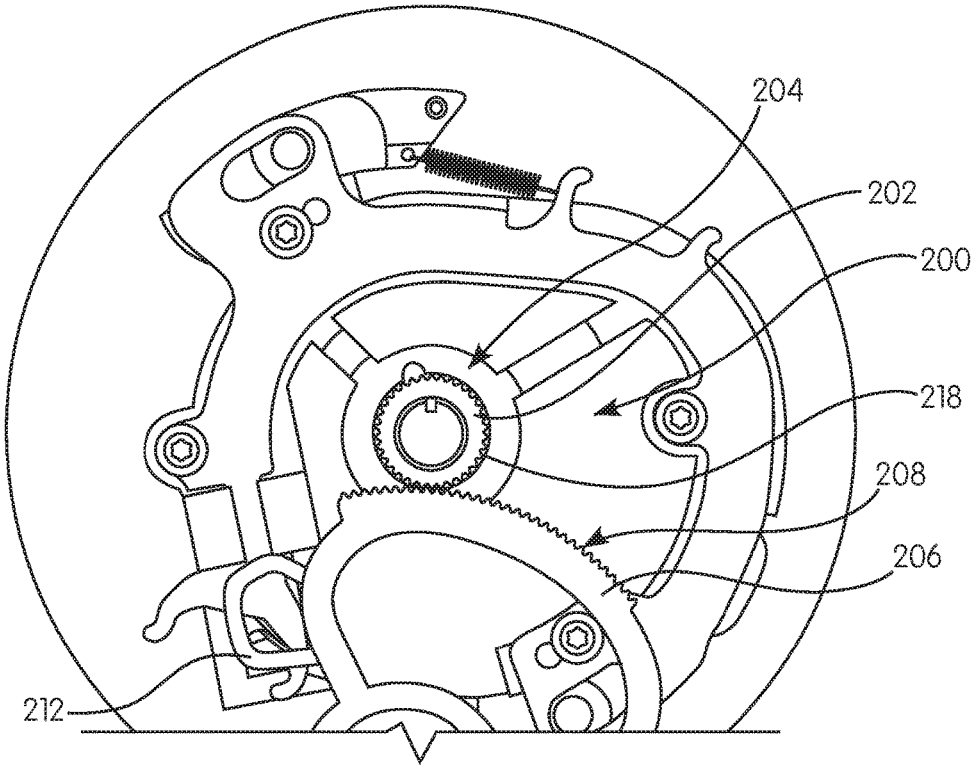
FIG. 11 is a partial side view of a further embodiment of a fall protection device and adjustment mechanism according to the principles of the present invention.

In another preferred and non-limiting embodiment or aspect of the adjustment mechanism 200, and as illustrated in FIG. 11, the at least one gear 204 is the central gear 202, which demonstrates a "direct drive" version of the adjustment mechanism 200. In this embodiment, the set of teeth 218 of the central gear 202 interacts or mates directly with the track 208 of the pivot 206, such that the relative spacing and positioning between the at least one gear 204 (i.e., the central gear 202) and the pivot 206 is adjusted. Further, in this embodiment, there is no revolution rate reduction provided, such that the pivot 206 will move on a substantially one-to-one basis with respect to the revolution rate of the central gear 202.

Figure 12:
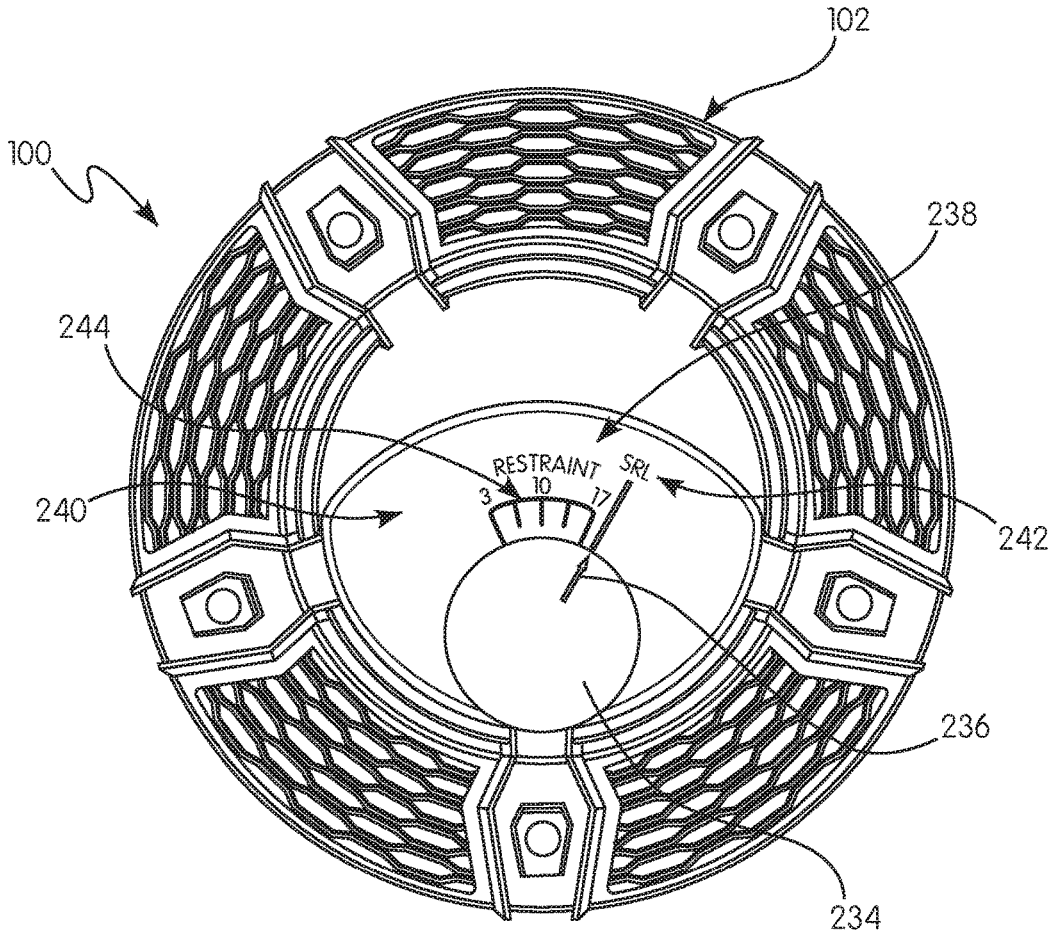
FIG. 12 is a side view of another embodiment of a fall protection device and adjustment mechanism according to the principles of the present invention.

As discussed, and based upon the integration of the adjustment mechanism 200 with a fall protection device 100 that operates as a self-retracting lanyard (e.g., a fall arrest device), the fall protection device 100 may act as both a SRL and a restraint device. In one preferred and non-limiting embodiment or aspect, and with reference to FIG. 12, the knob 234 includes at least one indication 236, such as a line, an arrow, a pointer, a marking, a projection, a recess, and/or the like. Further, a part, portion, or component of the fall protection device 100 (e.g., a portion of the housing 102) has at least one indication 238 disposed thereon, which includes a restraint indication area 240 and a SRL indication area 242. The restraint indication area 240 includes a scale 244 with numbers (or some similar marking) that indicates the amount of line 110 that should be permitted to be paid out from the housing 102 until the engagement mechanism 116 activates. Therefore, this position (or number) on the scale 244 corresponds with the contact or engagement point between the at least one gear 204 and the track 208 of the pivot 206, thereby providing the user instantaneous and understandable feedback on the amount of line 110 to be paid out and, accordingly, the distance to the potential hazard. Similarly, the SRL indication area 242 includes an indication that the fall protection device 100 is to be used as a self-retracting lanyard, and when in this position, the at least one gear 204 is disengaged from the track 208 of the pivot 206, which permits the fall protection device 100 to be used strictly as a fall arrest device (as opposed to a restraint device (or combined fall arrest device and restraint device)). It should be noted, however, that if the user accidentally sets the knob 234 to the incorrect length (e.g., a distance further than the actual distance to the hazard), the fall protection device 100 will still act as a fall arrest device in the event of a fall.

In another preferred and non-limiting embodiment or aspect, and with reference to setting the desired payout length of the line 110, the process may occur in one (or both) of two variations, including: (1) setting the indication 236 on the knob 234 to the appropriate distance using the scale 244 of the restraint indication area 240, which works effectively for a single user; and/or (2) if two or more people are available, implementing the following process: (i) the first person walks the connector 112 at the end of the line 110 to the desired payout distance at or near the hazard; (ii) the second person rotates the knob 234 (e.g., counter-clockwise) to the furthest extent when the first person is standing at the desired payout distance; and (iii) the second person will reengage the knob 234, thereby locking the fall protection device 100 to the desired payout length. This second process works well when the exact desired payout length is unknown (e.g., a measuring device is not available). In addition, it is envisioned that when two people are not available, the user may engage or otherwise fix the connector 112 at or near the hazard, and walk back to the anchor point, where the knob 234 can be used to engage the adjustment mechanism 200.

As seen, the engagement mechanism 116 may include multiple pawls 128 to prevent over-rotation of the hub 104 when the engagement mechanism 116 is activated. It is further envisioned that the at least one pawl 128 is urged against engagement with the at least one sperrad 120 (such as through the use of a spring (not shown)), so that engagement only occurs when the rotation speed of the hub 104 is fast enough to indicate that a "fall event" has occurred. Further, it should be recognized that the engagement mechanism 116 and the braking mechanism 118 are configured to interact to ensure that during a fall event, the hub 104 does not stop abruptly.

In one preferred and non-limiting embodiment or aspect, the arm 212 of the pivot 206 is configured to impact or contact at least one stud 140 projecting from the at least one pawl 128. In particular, and as best illustrated in FIG. 5, when the arm 212 is moved into a contact position by the pivoting of the pivot 206 (which is facilitated by the movement of the track 208 based on the rotation and interaction of the at least one gear 204), the arm 212 will contact the moving stud 140 of the at least one pawl 128 and urge it into an engagement position. Once moved into this engagement position, and as discussed above, the at least one pawl 128 will contact a portion of the stationary contact projection 122, thereby preventing further rotation of the hub 104 and payout of the line 110 (again, as first slowed by the braking mechanism 118). It should be recognized that different interactions between the adjustment mechanism 200 and the engagement mechanism 116 can be utilized to provide the same function. In this manner, the fall protection device 100 and adjustment mechanism 200 of the present invention allow a single fall protection device to be used as both a settable-length restraint device or system and a fall arrest device, e.g., a self-retracting lanyard. Further, when the fall protection device 100 and adjustment mechanism 200 are used as a restraint device or system, they still operate as a fall arrest device if the user falls over an edge.

While several embodiments of the fall protection device 100 and adjustment mechanism 200 are shown in the accompanying figures and described hereinabove in detail, other embodiments will be apparent to, and readily made by, those skilled in the art without departing from the scope and spirit of the invention. For example, it is to be understood that this disclosure contemplates that, to the extent possible, one or more features of any embodiment or aspect can be combined with one or more features of any other embodiment or aspect. Accordingly, the foregoing description is intended to be illustrative rather than restrictive.

What is claimed is:

1. A fall protection device, comprising:

a housing;

a rotatable hub having a body and a central rotation axis around which the body rotates with respect to the housing;

a line wrapped around the hub and configured to pay out from and retract into the housing, the line having a first end attached to the hub and a second end having a connector attached thereto and configured for attachment to a harness of a user;

an engagement mechanism configured to prevent rotation of the hub and further payout of the line; and an adjustment mechanism configured to adjust a predetermined length of the line paid out from the housing between a maximum length and a minimum length, the adjustment mechanism comprising: (i) a central gear configured to rotate with the hub about the central rotation axis; (ii) at least one gear attached to the housing and configured to interact with the central gear; (iii) a pivot having a track configured to interact with the at least one gear as the at least one gear rotates; and (iv) an arm on the pivot configured to urge at least a portion of the engagement mechanism into an engagement position after the predetermined length of the line is paid out from the housing to thereby prevent further rotation of the hub and payout of the line from the fall protection device.

2. The fall protection device of claim 1, wherein the at least one gear comprises a first set of teeth configured to directly or indirectly interact with the central gear and a second set of teeth configured to directly or indirectly interact with the track of the pivot.

3. The fall protection device of claim 1, wherein the at least one gear comprises a plurality of interacting gears configured to reduce the revolution rate of the at least one gear with respect to the revolution rate of the central gear.

4. The fall protection device of claim 1, wherein engagement and disengagement of the adjustment mechanism is effected through facilitating contact between the track of the pivot and the at least one gear.

5. The fall protection device of claim 1, wherein a distance that the pivot moves into the engagement position is adjustable, thereby providing a specified length of line to be paid out prior to the arm urging at least a portion of the engagement mechanism into the engagement position.

6. The fall protection device of claim 5, wherein the engagement position is adjusted by engaging the at least one gear with the track of the pivot at a specified point.

7. The fall protection device of claim 1, wherein the arm of the pivot contacts at least one stud projecting from at least one component of the engagement mechanism.

8. The fall protection device of claim 1, wherein the engagement mechanism comprises: (i) at least one sperrad attached to or integral with the housing; and (ii) at least one pawl attached to or integral with the hub and configured to contact at least a portion of the at least one sperrad, thereby preventing further rotation of the hub with respect to the housing.

9. An adjustment mechanism for adjusting a length of a line that is paid out from a fall protection device, comprising: (i) a central gear configured to rotate with a hub about a central rotation axis; (ii) at least one gear attached to a housing of the fall protection device and configured to interact with the central gear; (iii) a pivot having a track configured to interact with the at least one gear and pivot as the at least one gear rotates; and (iv) an arm configured to urge at least a portion of an engagement mechanism causing it to move into an engagement position, to thereby prevent further rotation of the hub and payout of the line from the fall protection device.

10. The adjustment mechanism of claim 9, wherein the at least one gear comprises a first set of teeth configured to directly or indirectly interact with the central gear and a second set of teeth configured to directly or indirectly interact with the track of the pivot.

11. The adjustment mechanism of claim 9, wherein the at least one gear comprises a plurality of interacting gears configured to reduce the revolution rate of the at least one gear with respect to the revolution rate of the central gear.

12. The adjustment mechanism of claim 11, wherein the plurality of interacting gears comprises: (i) a first gear comprising a first set of teeth configured to interact with the central gear and a second set of teeth; and (ii) a second gear comprising a first set of teeth configured to interact with the second set of teeth of the first gear and a second set of teeth configured to interact with the track of the pivot.

13. The adjustment mechanism of claim 12, wherein the radius of the second set of teeth of the first gear is less than the radius of the first set of teeth of the first gear, and the radius of the second set of teeth of the second gear is less than the first set of teeth of the second gear.

14. The adjustment mechanism of claim 9, wherein the engagement mechanism comprises: (i) at least one sperrad attached to or integral with the housing; and (ii) at least one pawl attached to or integral with the hub and configured to contact at least a portion of the at least one sperrad, thereby preventing further rotation of the hub with respect to the housing.

15. The adjustment mechanism of claim 9, wherein a distance that the pivot moves into the engagement position is adjustable.

16. The adjustment mechanism of claim 15, wherein the engagement position is adjusted by engaging the at least one gear with the track of the pivot at a specified point.

17. The adjustment mechanism of claim 9, further comprising a knob attached to the pivot and configured to facilitate engagement and disengagement of the at least one gear and the track of a pivot at a specified point.

18. The adjustment mechanism of claim 9, wherein the arm of the pivot contacts at least one stud projecting from an at least one pawl.

19. A fall protection device, comprising:

a housing;

a rotatable hub having a body and a central rotation axis around which the body rotates with respect to the housing;

a line wrapped around the hub and configured to pay out from and retract into the housing, the line having a first end attached to the hub and a second end having a connector attached thereto and configured for attachment to a harness of a user;

an engagement mechanism configured to prevent rotation of the hub and further payout of the line; and an adjustment mechanism configured to adjust a predetermined length of the line paid out from the housing between a maximum length and a minimum length, the adjustment mechanism comprising: (i) at least one gear attached to the housing; (ii) a pivot having a track configured to interact with the at least one gear and pivot as the at least one gear rotates; and (iii) an arm on the pivot configured to urge at least a portion of the engagement mechanism into an engagement position after the predetermined length of the line is paid out from the housing to thereby prevent further rotation of the hub and payout of the line from the fall protection device.

20. An adjustment mechanism for adjusting a predetermined length of a line that is paid out from a fall protection device between a maximum length and a minimum length, the adjustment mechanism comprising: (i) at least one gear attached to a housing of the fall protection device; (ii) a pivot having a track configured to interact with the at least one gear and pivot as the at least one gear rotates; and (iii) an arm on the pivot configured to urge at least a portion of an engagement mechanism into an engagement position after the predetermined length of the line is paid out from the housing to thereby prevent further rotation of the hub and payout of the line from the fall protection device.

* * * * *